US011524476B2

(12) United States Patent
Buresch

(10) Patent No.: US 11,524,476 B2
(45) Date of Patent: Dec. 13, 2022

(54) DEVICE FOR EMBOSSING FOILS

(71) Applicant: Gerhard Rauch Ges.m.b.H., Trasdorf (AT)

(72) Inventor: Anton Buresch, Trasdorf (AT)

(73) Assignee: Gerhard Rauch Ges.m.b.H., Trasdorf (AT)

( * ) Notice: Subject to any disclaimer, the term of this patent is extended or adjusted under 35 U.S.C. 154(b) by 0 days.

(21) Appl. No.: 17/472,851

(22) Filed: Sep. 13, 2021

(65) Prior Publication Data

US 2022/0080694 A1 Mar. 17, 2022

(30) Foreign Application Priority Data

Sep. 14, 2020 (EP) ..... 20196045

(51) Int. Cl.
*B31F 1/07* (2006.01)

(52) U.S. Cl.
CPC ..... *B31F 1/07* (2013.01); *B31F 2201/0753* (2013.01)

(58) Field of Classification Search
CPC ..... B31F 2201/0753; B31F 1/07
See application file for complete search history.

(56) References Cited

U.S. PATENT DOCUMENTS

2005/0257594 A1* 11/2005 Hutchison ..... B26D 7/2628 72/482.93
2008/0264284 A1* 10/2008 Hutchison ..... B44B 5/026 101/394
2012/0186471 A1* 7/2012 Hutchison ..... B41F 27/02 101/390
2015/0241875 A1* 8/2015 Ehrbar ..... G05B 19/41865 700/122

FOREIGN PATENT DOCUMENTS

DE 102016114026 A1 2/2018
EP 1099509 A1 5/2001
EP 1457275 A1 9/2004
EP 3197616 A1 8/2017
EP 3321097 A1 5/2018
JP H08281340 A 10/1996

OTHER PUBLICATIONS

European Search Report (in German) Regarding International Application No. 20196045.7, dated Mar. 16, 2021.

* cited by examiner

*Primary Examiner* — David H Banh
(74) *Attorney, Agent, or Firm* — Harness, Dickey & Pierce, P.L.C.

(57) ABSTRACT

A device for embossing foils comprises a base embossing plate and a counter embossing plate, the surfaces of which facing one another are respectively at least partially planar for embossing a foil lying between them. The base embossing plate is provided with a plurality of embossing inserts for embossing a plurality of blanks to be punched out of the foil. Each embossing insert is held at the base embossing plate by means of an own embossing insert retainer so as to be movable a predetermined amount relative to the base embossing plate in the direction normal to the at least partially planar surface of the base embossing plate, is at the same time spring-borne relative to the base embossing plate by means of an own embossing insert suspension and is guided by means of an own embossing insert guide during the spring-borne movement relative to the base embossing plate.

12 Claims, 3 Drawing Sheets

DEVICE FOR EMBOSSING FOILS

CROSS-REFERENCE TO RELATED APPLICATIONS

The present application claims the benefit and priority of European Patent Application No. EP 201960457, filed Sep. 14, 2020. The entire disclosure of the application referenced above is incorporated herein by reference.

FIELD

The disclosure relates to a device for embossing foils, including a base embossing plate and a counter embossing plate, the surfaces of which facing one another are respectively at least partially planar and which, for embossing a foil lying between them, are arranged so as to be movable on the one hand towards one another and on the other hand away from one another in parallel alignment of their at least partially planar surfaces, wherein the base embossing plate is provided on its side facing the counter embossing plate with a plurality of embossing inserts for embossing a plurality of blanks to be punched out of the foil and wherein the embossing inserts are configured and arranged in such a way that, during embossing of the foil, they respectively cooperate with a corresponding embossing area arranged on the side of the counter embossing plate facing the base embossing plate.

BACKGROUND

When we talk about embossing a foil, this also refers to the deformation of foils in general. In this context, smooth foils can be embossed or deformed, but also already pre-embossed or pre-deformed foils.

Foils in the packaging sector, also known as blanks, typically have a thickness between 10 and 150 μm and can be provided with a wide variety of embossings. These embossings can be carried out over the entire surface, partially or as edge embossing. The reason for these embossings is typically to ensure the separation of the foils when they are provided for their application to e.g. a container in the form of a foil stack, as explained below.

Such foils, also called sealing foils, are used in the packaging industry for a variety of different products, for example as closure for corresponding packaging containers, such as cups or boxes. Here, the sealing foils are often obtained by punching out corresponding shapes from a strip-shaped material. The material used here can be, for example, aluminum foil, plastic foil or composite materials made of plastic and aluminum. The material is often printed on at least one or both sides. In order to close packaging containers, the sealing foils are typically glued or welded onto the containers. For this purpose, the foils can be provided with a layer of heat-sealing lacquer on the side facing the packaging container, for example.

After punching out a shape corresponding to the opening of the packaging container to be closed from a web material, the obtained shaped pieces are usually stacked. In order to close the packaging container, the shaped pieces, which are intended for example as lids, are removed from the stack with suitable gripping systems, such as vacuum grippers, and arranged on the opening of the packaging container to be closed. Depending on the application system used, such as by means of heat-sealing lacquer, the shaped pieces provided as lids are then bonded to the packaging container under the action of pressure and/or heat. In order to prevent that several shaped pieces adhere to each other when the shaped pieces are lifted from the stack, it is known from the state of the art to provide the shaped pieces with an embossing in the edge region, which prevents the individual shaped pieces from adhering to each other. It is also known that embossings are partially omitted in order to achieve better readability by barcode scanners. In order to carry out these various embossings, processes using engraved rollers or embossing plates are known. These embossings can also be carried out in a controlled manner via tactile marks to the printed image.

A frequently occurring problem is that the foils to be embossed can have differences in material thickness of up to 5 μm over the embossing width. As a rule, 2 to 18 blanks to be punched out are arranged over the embossing width. Therefore, in many cases different embossing depths for the different punched blanks are present. This has negative effects on the destackability as well as the stability of a stack of blanks produced in this way. If, for example, the embossing depth of the individual blanks varies considerably in the case of pure edge embossing, a stable stack of blanks cannot be formed, which can lead to considerable problems at the filling line—targeted removal is often not possible in this case.

SUMMARY

Based on this, it is the object of the disclosure to provide a device for embossing thin-walled foils that comes closer to the goal of ensuring an embossing depth that is independent of the material thickness of the foil.

Thus, according to the disclosure, a device for embossing foils is provided, including a base embossing plate and a counter embossing plate, the surfaces of which facing one another are respectively at least partially planar and which, for embossing a foil lying between them, are arranged so as to be on the one hand movable towards one another and on the other hand away from one another in parallel alignment of their at least partially planar surfaces, wherein the base embossing plate is provided on its side facing the counter embossing plate with a plurality of embossing inserts for embossing a plurality of blanks to be punched out of the foil, and wherein the embossing inserts are configured and arranged in such a way that, during embossing of the foil, they respectively cooperate with a corresponding embossing area arranged on the side of the counter embossing plate facing the base embossing plate, characterised in that each embossing insert is held on the base embossing plate by means of an own embossing insert retainer so as to be movable by a predetermined amount relative to the base embossing plate in the direction perpendicular to the at least partially plane surface of the base embossing plate, is at the same time spring-borne relative to the base embossing plate by means of an own embossing insert suspension and is guided by means of an own embossing insert guide during the spring-borne movement relative to the base embossing plate enabled thereby.

It is thus an essential aspect of the disclosure that a device for embossing foils, which is otherwise constructed in a conventional manner, is provided on its base embossing plate with such embossing inserts, which each have an own embossing insert retainer, an own embossing insert suspension and an own embossing insert guide. The fact that each embossing insert is provided with an own embossing insert retainer, an own embossing insert suspension and an own embossing insert guide means that for each embossing insert separately such devices are provided which only cooperate with this embossing insert and with no other. In this way, the disclosure enables the movement of each embossing insert during embossing of the foil to be independent of the movements of the other embossing inserts. In particular, this allows the embossing inserts to behave in such a way that they "react" independently of each other to different foil thicknesses so that, despite the different thicknesses, essentially the same embossing depth is obtained. If the foil to be embossed has differences in its material thickness over its surface, this can be compensated for by the separate bearing, suspension and guidance of the individual embossing inserts. Fluctuations in the foil thickness, which would otherwise have led to different embossing depths, can thus be compensated. In the best case, practically the same embossing depth can be achieved with each embossing insert.

Here, the embossing insert retainer ensures the basic fastening of the embossing insert to the base embossing plate. This fastening is such that the embossing insert is basically movable relative to the base embossing plate, namely a movement in the normal direction to the at least partially planar surface of the base embossing plate is possible. This corresponds to a movement of an embossing insert relative to the base embossing plate in a direction parallel or anti-parallel to the direction in which the base embossing plate and the counter embossing plate are moved towards each other for embossing the foil. This means that each embossing insert during embossing, namely when the foil is compressed between a respective embossing insert and a corresponding embossing area on the counter embossing plate, a certain "yielding" of the respective embossing insert towards the base embossing plate is made possible. This retracting or yielding of the respective embossing insert takes place in a controlled manner due to the embossing insert suspension associated with the respective embossing insert in combination with the respective embossing insert guide, so that even in the case of different material thicknesses across the surface of the foil to be embossed, differences in the embossing depths for the different embossing inserts can be reduced or completely avoided.

For this purpose, the embossing insert retainers can be designed in different ways. However, according to a preferred further development of the disclosure it is provided that the embossing insert retainers each comprise a damping device for damping the possible movement of the respective embossing insert relative to the base embossing plate. Such a damping device thus offers a certain resistance to the movement of the respective embossing insert, which makes the movement of the embossing insert relative to the base embossing plate more controllable.

To this end, different damping devices may be provided. However, according to a preferred further development of the disclosure, the damping device respectively comprises a spring bolt and/or a damping disc. Here, it is particularly preferred that the embossing inserts are respectively held on the base embossing plate by means of a fastening means, wherein the fastening means is passed through the damping device. If, for example, in connection with this preferred embodiment of the disclosure, a spring bolt is provided in combination with a damping disc as a damping device, a screw is preferably passed through these components by means of which the respective embossing insert is fixed to the base embossing plate.

Different designs are possible for the embossing insert guides, too. According to a preferred further development of the disclosure, the embossing insert guides respectively comprise a column guided in a bush. In this case, moreover, it is preferably provided, that the column of a respective embossing insert guide is fixed in the respective embossing insert and the bushing is fixed in the basic embossing plate.

With regard to the embossing insert suspensions it is essential that these ensure a certain spring-borne mounting of the embossing inserts with respect to the base embossing plate. For this purpose, a respective embossing insert suspension is preferably designed in such a way that it comprises an elastic element attached to the respective embossing insert. Moreover, according to a preferred further development of the disclosure it is provided that each embossing insert is provided with a plurality of embossing insert guides and/or with a plurality of embossing insert suspensions. Furthermore, according to a preferred further development of the disclosure, the shape of the embossing inserts is substantially round, wherein the embossing insert retainer is arranged centrally in each embossing insert. In this way, a particularly stable support and guidance of the embossing inserts at the base embossing plate is ensured.

The device for embossing foils according to the disclosure can also be designed differently with regard to the transport of the foil to be embossed and the arrangement of the embossing inserts. However, according to a preferred further development of the disclosure, it applies that it comprises a transport device by means of which the foil to be embossed is movable in a transport direction relative to the base embossing plate, wherein at least a part of the plurality of embossing inserts are arranged side by side in a direction perpendicular to the transport direction. In other words, according to this preferred further development of the disclosure it is further provided, that at least some of the embossing inserts are arranged in the width perpendicular to the working direction given by the transport direction of the foil. According to a preferred further development of the disclosure it is further provided, that the embossing inserts, which are arranged side by side in a direction perpendicular to the transport direction, are at least partially arranged offset to each other in the transport direction. Such an offset arrangement makes it possible to arrange a greatest possible number of embossing inserts on the area given by the base embossing plate, in the case of essentially round embossing inserts, for example, in the form of a practically hexagonal arrangement of the embossing inserts relative to one another, which leads to practically optimum utilization of the available area.

Regarding the embossing areas in the counter plate corresponding to the embossing inserts provided in the base embossing plate, these can basically be designed in a conventional manner. According to a preferred further development of the disclosure, it is provided in this context, that the embossing areas corresponding to the embossing inserts provided in the base embossing plate are designed as inserts that are detachably fixed in the counter plate. In particular, the embossing areas designed as such inserts can be screwed into the counter plate. In accordance with a preferred further development of the disclosure, it is provided, that the inserts are mounted in the counterplate in an unsprung manner, preferably screwed into the counterplate in an unsprung manner.

In the following, the disclosure will be further explained in detail by means of a preferred exemplary embodiment with reference to the drawings.

DRAWINGS

FIG. 1 schematically shows a system for embossing foils and punching out blanks by use of a device for embossing foils according to a preferred exemplary embodiment of the disclosure;

FIGS. 2*a-d* show the device for embossing foils from FIG. 1 in different views;

DETAILED DESCRIPTION

Figure 1:
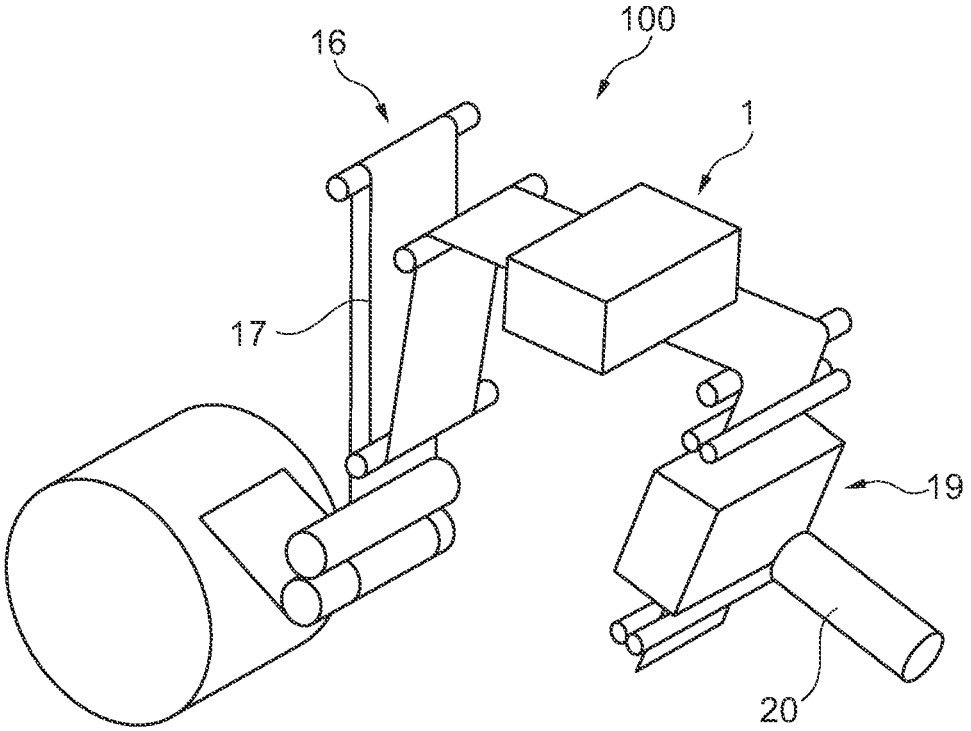

FIG. 1 schematically shows an embossing and punching system 100 by means of which embossed sealing lids can be punched out of a web-shaped foil 17, such as an aluminum foil or an aluminum/plastic composite foil. For this purpose, the system 100 comprises a transport device 16 which first feeds the web-shaped foil 17 to an embossing device 1. The embossing device 1 is explained in detail below. The foil 17 embossed by the embossing device 1 is then fed to a punching device 19, by means of which embossed foil elements, also referred to as blanks, are punched out. The embossed and punched out foil elements are finally stacked in a stack 20 and are thus available for further processing.

For a detailed description of the embossing device 1 according to the present preferred embodiment of the disclosure, reference is made below to FIG. 2*a*, which shows a sectional view of the embossing device 1, to FIG. 2*b*, which shows a plan view, partly in section, of the embossing device 1, to FIG. 2*c*, which shows a side view of the embossing device 1 along its long side, and to FIG. 2*d*, which shows a side view of the embossing device 1 along its short side. As can be seen, for example, from FIG. 2*a*, the embossing device comprises a base embossing plate 2 and a counter embossing plate 3. The major part of the surfaces of the base embossing plate 2 and the counter embossing plate 3 are formed by planar sections which are parallel to each other, namely extend horizontal in the sectional view shown in FIG. 2*a*. The base embossing plate 2 is connected to the counter embossing plate 3 by means of embossing guides 21 in such a way that the base embossing plate 2 and the counter embossing plate 3 can be moved on the one hand towards each other and on the other hand away from each other in parallel alignment to each other. By moving the base embossing plate 2 away from the counter embossing plate 3, the embossing device 1 is practically opened so that the foil 17 to be embossed can be guided between the base embossing plate 2 and the counter embossing plate 3. For the actual embossing process, the base embossing plate 2 and the counter embossing plate 3 are moved towards each other, so that finally the actual embossing process of the foil 17 between the base embossing plate 2 and the counter embossing plate 3 takes place.

For this embossing process, the base embossing plate 2 is provided with a plurality of, in this case eight, embossing inserts 4 which correspond to eight embossing areas 5 in the counter embossing plate. These embossing areas 5 in the counter embossing plate 3 are designed in the present case in the form of inserts which are screwed into the counter embossing plate 3 in an unsprung manner, namely by means of screws 18. The surfaces of the embossing areas 5 and the embossing inserts 4 facing each other are designed, as is known from conventional embossing devices, in such a way that during the actual embossing process the desired embossing occurs at the foil lying between the embossing inserts 4 and the embossing areas 5.

Figure 2:
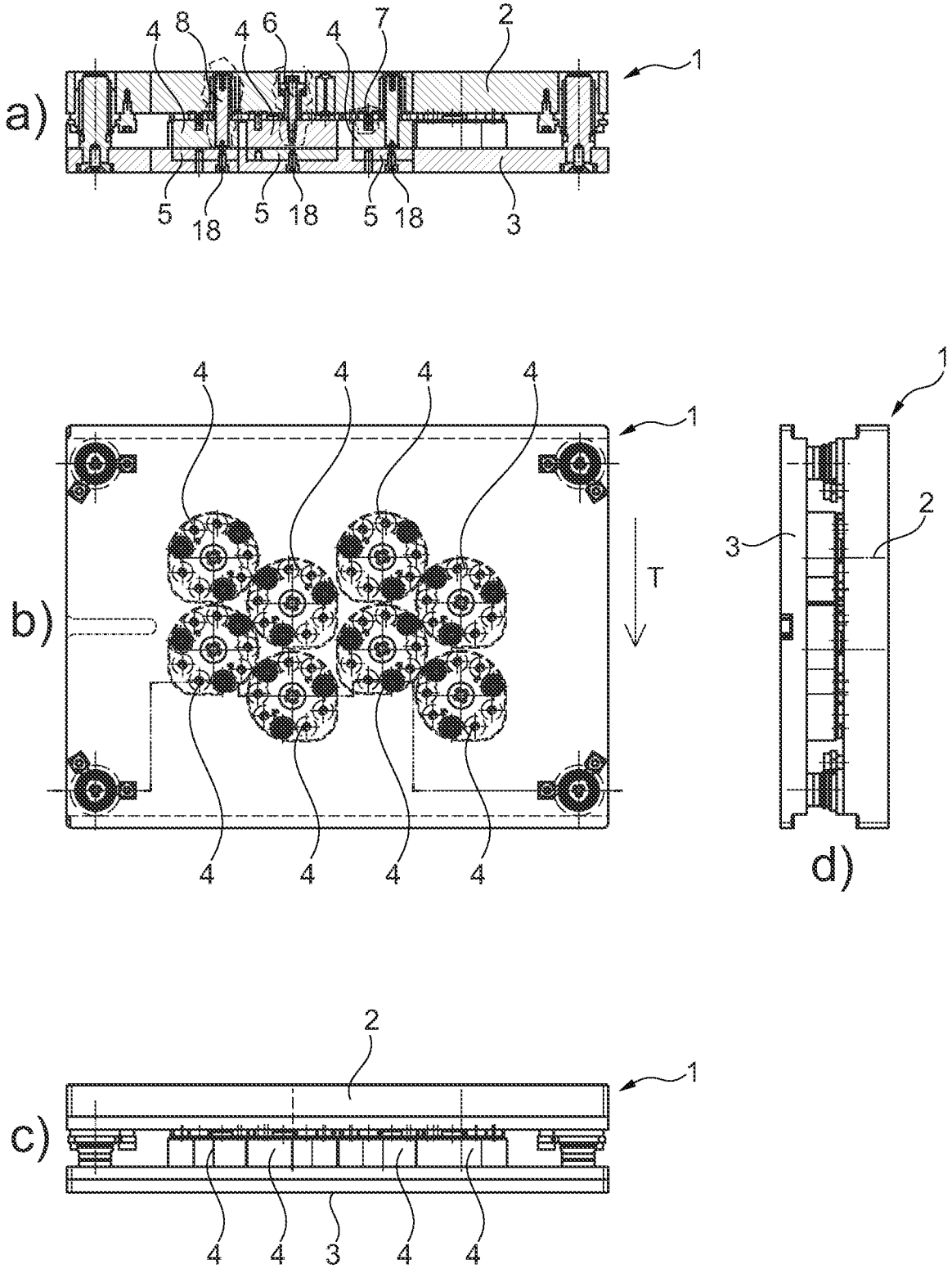

As can be seen in particular in FIG. 2*b*, the embossing inserts 4 and thus also the embossing areas 5 are arranged side by side perpendicular to the transport direction T designated with an arrow in FIG. 2*b*. In addition, the embossing inserts 4 and thus also the embossing areas 5 are also arranged offset to each other in the transport direction. This leads to a practically optimal utilization of the available area.

It is now essential that the embossing device 1 according to the preferred exemplary embodiment of the disclosure described herein comprises such embossing inserts 4, each of which is held at the base embossing plate 2 by means of an own embossing insert retainer 6 in the normal direction, i.e. in FIG. 2*b* perpendicular to the plane of the drawing, so as to be movable by a predetermined amount relative to the plane surfaces of the base embossing plate 2, are at the same time spring-borne relative to the base embossing plate 2 by means of an own embossing insert suspension 7 and are guided by means of an own embossing insert guide 8 during the spring-borne movement relative to the base embossing plate 2 enabled thereby.

Here, the embossing insert retainer 6 ensures the basic fastening of the embossing insert 4 to the base embossing plate 2 in such a way that a certain movement of the embossing insert 4 remains possible. This corresponds to a movement of the embossing insert 4 relative to the base embossing plate 2 in a direction parallel or anti-parallel to the direction in which the base embossing plate 2 and the counter embossing plate 3 are moved towards each other for embossing the foil 17. This means that each embossing insert 4 during embossing, namely when the foil 17 is compressed between a respective embossing insert 4 and a corresponding embossing area 5 on the counter embossing plate 3, a certain "yielding" of the respective embossing insert 4 towards the base embossing plate 2 is enabled.

In this way, differences in the embossing depths of the different embossing inserts 4 can be reduced or completely avoided, even with different material thicknesses over the surface of the foil 17 to be embossed. Specifically, to this end, each of the eight embossing inserts 4 comprises a centrally arranged embossing insert retainer, three embossing insert guides 8 and six embossing insert suspensions 7. These are designed as described below.

Figure 3:
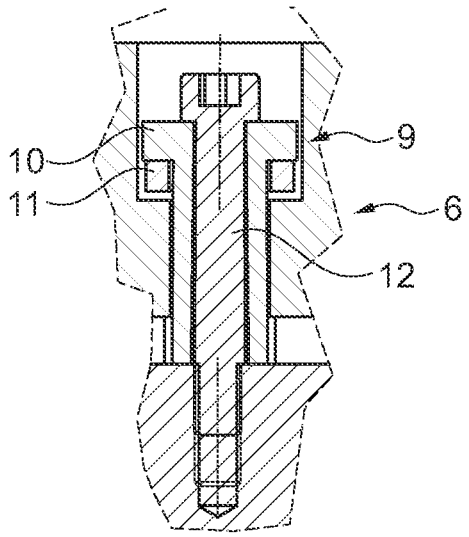
FIG. 3 shows a sectional view of an embossing insert retainer of the device for embossing foils according to the preferred exemplary embodiment of the disclosure described herein.

FIG. 3 shows a sectional view of such an embossing insert retainer 6. It can be seen that the embossing insert retainer 6 comprises a damping device 9 for damping the possible movement of the embossing insert 4, at which it is provided, relative to the embossing plate 2. Here, the damping device 9 comprises a spring bolt 10 and a damping disc 11. A fastening means 12 in the form of a screw, by means of which the respective embossing insert is held on the base embossing plate 2, is passed through the spring bolt 10 and the damping disc 11. The fact that this mounting allows a certain movement of the embossing insert 4 relative to the base embossing plate 2 is due to the spring bolt 10 and the damping washer 11.

Figure 4:
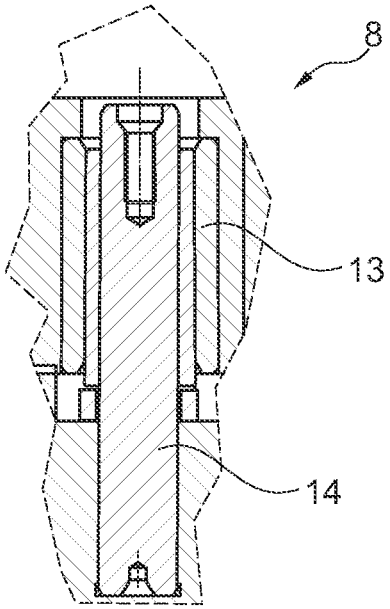
FIG. 4 shows a sectional view of an embossing insert guide of the device for embossing foils according to the preferred exemplary embodiment of the disclosure described herein.

FIG. 4 now shows an embossing insert guide 8, also in section. Here, it can be seen that the embossing insert guide 8 comprises a column 14 guided in a bushing 13. The column 14 is fixed in the respective embossing insert 4, while the bushing 13 is held in the base embossing plate 2.

Figure 5:
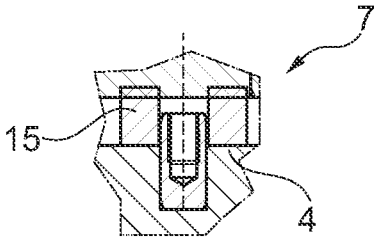
FIG. 5 shows a sectional view of an embossing insert suspension of the device for embossing foils according to the preferred exemplary embodiment of the disclosure described herein.

Finally, FIG. 5 shows a sectional view of the embossing insert 7 used here. It can be seen that the embossing insert suspension 7 comprises an elastic element 15 attached to the respective embossing insert 4. This elastic element is preferably made of a rubber material.

What is claimed is:

1. A device for embossing foils, comprising a base embossing plate and a counter embossing plate, the surfaces of which facing one another are respectively at least partially planar and which, for embossing a foil lying between them, are arranged so as to be movable on the one hand towards one another and on the other hand away from one another in parallel alignment of their at least partially planar surfaces, wherein the base embossing plate is provided on its side facing the counter embossing plate with a plurality of embossing inserts for embossing a plurality of blanks to be punched out of the foil, and wherein the embossing inserts are configured and arranged such that during embossing of the foil they respectively cooperate with a corresponding embossing region arranged on the side of the counter embossing plate facing the base embossing plate, wherein each embossing insert is held at the base embossing plate by means of an own embossing insert retainer so as to be movable by a predetermined amount relative to the base embossing plate in the direction perpendicular to the at least partially planar surface of the base embossing plate during embossing of the foil, is at the same time spring-borne relative to the base embossing plate by means of an own embossing insert suspension and is guided by means of an own embossing insert guide during the spring-borne movement relative to the base embossing plate during the embossing of the foil.

2. A device according to claim 1, wherein the embossing insert retainers respectively comprise a damping device for damping the possible movement of the respective embossing insert relative to the base embossing plate.

3. A device according to claim 2, wherein the damping devices respectively comprise a spring bolt and/or a damping disc.

4. A device according to claim 1, wherein the embossing inserts are respectively held at the base embossing plate by means of a fastening means, wherein the fastening means are respectively passed through the respective damping device.

5. A device according to claim 1, wherein the embossing insert guides respectively comprise a column guided in a bushing.

6. A device according to claim 5, wherein the column is fixed in the respective embossing insert and the bushing is fixed in the basic embossing plate.

7. A device according to claim 1, wherein the embossing insert suspensions respectively comprise an elastic element attached to the respective embossing insert.

8. A device according to claim 1, wherein each embossing insert is provided with a plurality of embossing insert guides and/or with a plurality of embossing insert suspensions.

9. A device according to claim 1, wherein a transport device by means of which the foil to be embossed is movable in a transport direction relative to the base embossing plate, wherein at least part of the plurality of embossing inserts are arranged side by side in a direction perpendicular to the transport direction.

10. A device according to claim 9, wherein part of the plurality of embossing inserts arranged side by side in a direction perpendicular to the transport direction are at least partially arranged offset to each other in the transport direction.

11. A device according to claim 1, wherein the embossing areas corresponding to the embossing inserts provided in the base embossing plate are configured as inserts detachably fixed in the counter embossing plate.

12. A device according to claim 11, wherein the inserts are mounted in the counter embossing plate in an unsprung manner.

* * * * *